US006270072B1

(12) United States Patent
Louie

(10) Patent No.: US 6,270,072 B1
(45) Date of Patent: Aug. 7, 2001

(54) TOP CARD FEEDER

(75) Inventor: Danny Louie, Thousand Oaks, CA (US)

(73) Assignee: ZIH Corporation, Wilmington, DE (US)

( * ) Notice: Subject to any disclaimer, the term of this patent is extended or adjusted under 35 U.S.C. 154(b) by 0 days.

(21) Appl. No.: 09/351,104

(22) Filed: Jul. 6, 1999

(51) Int. Cl.[7] ..... B65H 1/26

(52) U.S. Cl. ..... 271/157; 271/160; 221/227; 221/279

(58) Field of Search ..... 271/157, 160; 221/227, 279, 154

(56) References Cited

U.S. PATENT DOCUMENTS 545,803 * 9/1895 Klug ..... 221/227
769,963 * 9/1904 Sexton ..... 221/154
2,383,207 * 8/1945 Morrell ..... 221/227
4,905,869 * 3/1990 Grigsby et al. ..... 221/279
5,181,713 * 1/1993 Neugebauer ..... 271/160
5,335,901 * 8/1994 Nonomura et al. ..... 271/157
5,411,246 * 5/1995 Nonomura et al. ..... 271/157

FOREIGN PATENT DOCUMENTS

422463 * 3/1911 (FR) ..... 221/227

* cited by examiner

*Primary Examiner*—H. Grant Skaggs
(74) *Attorney, Agent, or Firm*—Fulbright & Jaworski LLP

(57) ABSTRACT

A top card feeder feeds cards into a receiving device from the top, the top card feeder having a card holder for holding a stack of cards, a door pivotally mounted near the bottom of the top card feeder, an elastic means adapted to pull the card holder upward, a locking mechanism adapted to lock the door and to rotate a pulley assembly in response to the movement of the door, the pulley assembly being coupled to the card holder for moving the card holder vertically within a chamber of the top card feeder.

38 Claims, 2 Drawing Sheets

TOP CARD FEEDER

FIELD OF THE INVENTION

The present invention relates generally to a medium feeding device, and more particularly to a card feeder for feeding cards into a receiving device through the top of the card feeder.

BACKGROUND OF THE INVENTION

Card feeders have been used in conjunction with receiving devices, such as printers or plastic laminators, for many years. A conventional card feeder has a card holder, acting like a storage stack, for holding a stack of cards to be fed into the receiving device attached to the card feeder for further processing of the cards. The card holder is positioned within the card feeder to form a chamber for storing the cards. The depth of the chamber varies depending on how many cards are stored in the card feeder. Moreover, the commercially available cards on the market are predominantly rectangular shaped and are made of paper or plastic materials. Therefore, to ensure every card is in line with other cards of the card stack for a proper feeding position, the card holder is typically of rectangular shape and is slightly larger than the size of a conventional business card.

The conventional card feeder has an opening to allow the cards to be removed from the card feeder. The opening of the card feeder may be on the top, or at the bottom, of the card holder depending on the configuration of the receiving device coupled to the card feeder. A feeding mechanism contacts, or is positioned in close proximity to, the card stack to retrieve the cards through the opening of the card feeder. To ensure proper operation of the receiving device, the feeding mechanism retrieves only one card each time from the card stack. Otherwise, if two or more cards were fed into the printer simultaneously, a blank card might be attached to a printed card coming out of the printer, or they may jam the printer and/or the card feeder. Therefore, the feeding mechanism and the card feeder have to be carefully designed to ensure only one card is retrieved at a time.

The card holder ordinarily has a platform at the bottom to uphold the card stack. To properly feed a card into the receiving device, such as a printer, the cards in the card holder have to be tightly packed, but not so tight as to cause any difficulty in removing the cards by the feeding mechanism. In addition, there should be no gap between any two cards or between the bottommost card and the platform. Otherwise, the feeding mechanism might not be able to properly remove the cards from the card feeder. To remove a card from the stack, the feeding mechanism also has to be suitably designed to overcome friction on either side of the card to be removed. The removing force of the feeding mechanism, thus, depends on how strong the friction is to be overcome during the removal of the cards. For any feeding mechanism, the removing force needed depends on the configuration of the card feeder and is substantially constant and predetermined once manufactured.

For a bottom card feeder, i.e., the opening for removing the cards is at the bottom of the card feeder, the accumulative weight of the card stack causes proper alignment of the cards to be fed. Since each card, except the bottommost card, is on top of other card(s), the weight of all other card(s) above that card will urge that card to lie evenly without gaps against an underlying card. As a result, the bottommost card will be positioned properly and is ready to be retrieved by the feeding mechanism.

The conventional bottom card feeder, however, has a major drawback, i.e., the accumulative weight of the card stack relative to each card in the stack is nonlinear. As a result, the bottommost card of the card stack will experience a much stronger accumulative weight relative to the uppermost card, which experiences no weight at all. Since the friction experienced by each card of the stack is a function to the weight, the friction experienced by each card of the stack is thus nonlinear also. As mentioned, the removing force of the feeding mechanism is substantially constant once manufactured and cannot be self-adjusted according to the variation of friction when the card stack moves from full to empty. The feeding mechanism, therefore, faces a dilemma, i.e., it has to be powerful enough to remove the bottommost card of a full stack and, at the same time, it has to be gentle enough to remove the uppermost card of an empty stack. The level of the removing force of the feeding mechanism thus has to be chosen carefully. If the feeding mechanism removes the card too forcefully, it will possibly cause some problems to the receiving device and/or the card feeder when it feeds the card into the receiving device. On the other hand, if the removing force of the feeding mechanism is not strong enough, it cannot retrieve some cards from the card stack. This causes some difficulties for a manufacturer to provide a proper level of removing force of the feeding mechanism.

To avoid the above-mentioned problems, some manufacturers provide top card feeders, i.e., feeding the cards from the top of the card holder, to the receiving devices. For a conventional top card feeder, the cards are fed into an attached receiving device through the top of the card holder. In contrast to the bottom card feeder, the uppermost card in a conventional top card feeder will be the first card to be removed from the card stack. Since there is no accumulative weight over a then uppermost card waiting for removal, every card in the stack in the top card feeder experiences substantially constant frictions, as compared to the bottom card feeder, during the removal of that card. A manufacturer of the feeding mechanism, therefore, has few problems choosing a proper level of removing force.

The conventional top card feeders are, however, not without disadvantages. Typically, a conventional top card feeder has a spring as a counterweight to pull or push up a card holder having a stack of cards positioned thereon. The conventional top card feeder has fixed surrounding walls forming a chamber to store the card stack. To load the card stack into the card feeder, a user will have to push down on the card holder to create space for loading the card stack. The user thus normally has to use both hands, one for pushing down and holding the card holder and one for holding and loading the cards, to load the card stack into the conventional top card feeder. This is inconvenient and it often causes trouble during loading. For example, the user's hands are, in most cases, larger than the cards to be loaded in the card feeder. It is, therefore, difficult to put hands into the card feeder in order to push and hold the card holder for loading. Also, if the user does not hold the card holder firmly during loading, the card holder will likely bounce back and mess up the orderly placed card stack, and it will possibly hurt the hands of the user.

SUMMARY OF THE INVENTION

An object of the present invention is thus to provide a card feeder feeding cards into a receiving device from the top and is convenient to load a card stack into the card feeder. The object is met by providing a top card feeder having a loading mechanism for an easy loading of the card stack, as indicated in the claims appended hereto.

In one embodiment of the present invention, the top card feeder has a loading assembly comprising a door coupled to a door release for opening the door to facilitate loading of the card stack into the card feeder. The loading assembly further comprises a locking mechanism to lock the card holder in a station position to facilitate loading of the card stack.

The foregoing and additional features and advantages of this present invention will become apparent by way of non-limitative examples shown in the accompanying drawings and detailed description that follow. In the figures and written description, numerals indicate the various features of the invention, like numerals referring to like features throughout for both the drawing figures and the written description.

BRIEF DESCRIPTION OF THE INVENTION

DETAILED DESCRIPTION OF THE INVENTION

Figure 1:
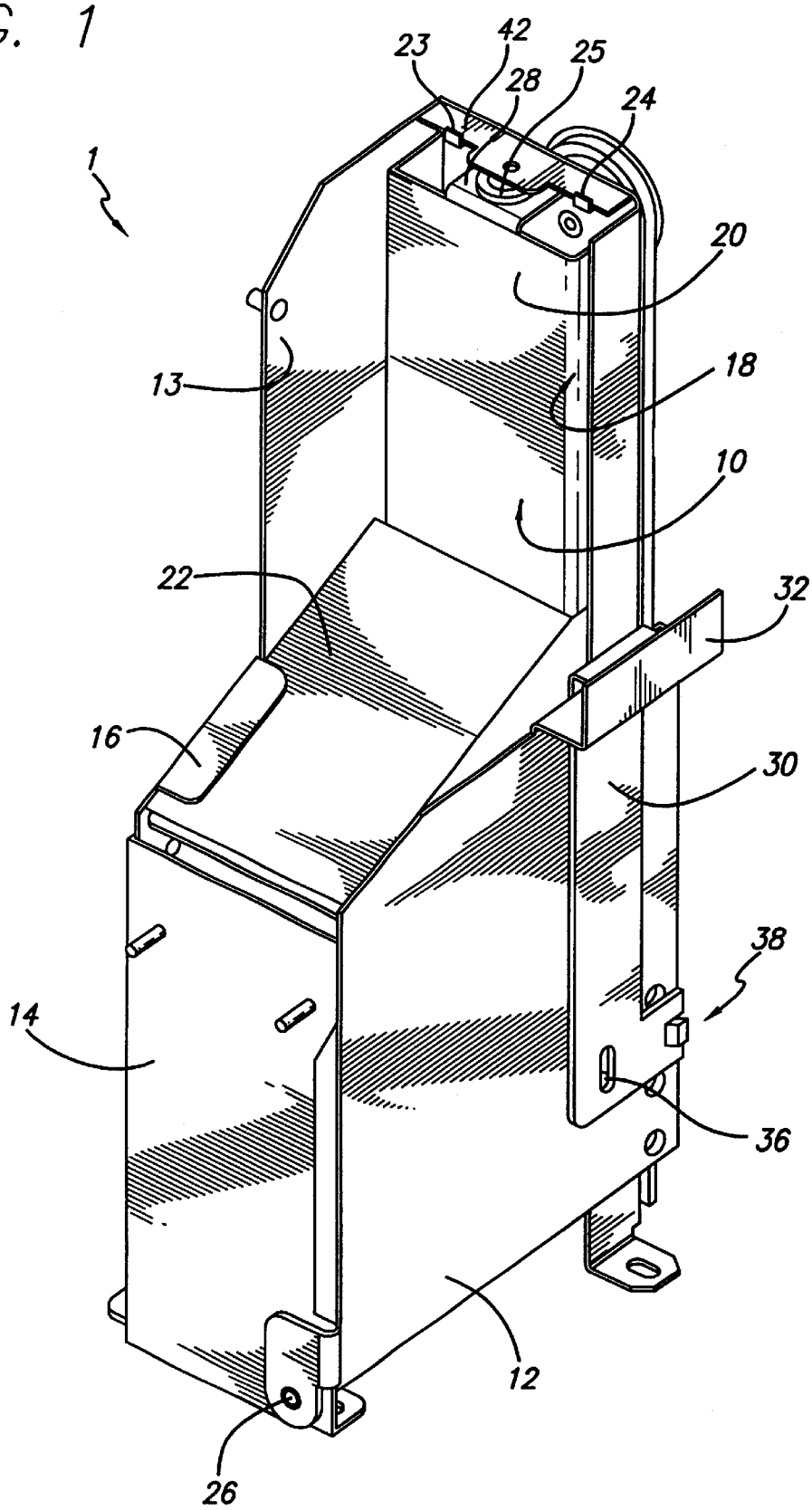
FIG. 1 shows a front isometric view of the card feeder according to the present invention.

In a preferred embodiment, as shown in FIG. 1, a top card feeder 1 according to the present invention comprises a card holder 10 for holding a stack of cards (not shown) to be fed into a receiving device (not shown). The card holder 10 includes a vertical element 18 and a platform 22. The vertical element 18 is coupled to the platform 22 at the bottom for moving the platform 22 vertically within a chamber formed by three side walls (front, left, and back) and a door 12 of the card feeder 1. In the preferred embodiment shown in FIG. 1, the top surface of the platform 22 is angled making it easier for a feeding mechanism (not shown) of the receiving device to retrieve the cards. In another embodiment, the top surface of the platform 22, however, may be horizontally positioned. The depth of the chamber, i.e., when the platform 22 moves downward in the chamber, determines the number of cards to be stacked onto the card holder 10. The front side wall 14 of the card feeder 1 faces toward the receiving device, and the feeding mechanism is positioned just above and in the proximity of the card feeder 1. The feeding mechanism may or may not, depending on different configurations of the feeding mechanism, touch an uppermost card of the card stack to retrieve the uppermost card, and the cards are retrieved sequentially by the feeding mechanism from the top of the card stack. In yet another embodiment, the feeding mechanism may be integrated into the card feeder 1.

In the preferred embodiment, the left side wall 13 has a card stop 16, as shown in FIG. 1. When the door 12 is completely close, i.e., when the platform 22 is in its uppermost position, the top surface of the platform 22 should come very close to, but not touching, the card stop 16. Ideally, when the door 12 is close, the space between the top surface of the platform 22 and the card stop 16 should not exceed the thickness of a card in the card stack. Therefore, the top surface of the platform 22 gently presses the uppermost card of the card stack against the card stop 16 and the uppermost card will not slide off the card holder 10 without a removing force from the feeding mechanism. The card stop 16 is ordinarily formed by a bent extrusion of the left side wall 13, but other embodiments, such as extrusions from other parts of the card feeder 1, may be possible.

The vertical element 18 of the card holder 10 is like a laterally-extended n shape cover having a vertical wall 20 with a backward extrusion 28 fixedly coupled to the vertical wall 20 on the top of the vertical element 18. The vertical wall 20 is spaced apart from a back wall 60 of the card feeder 1, leaving rooms for housing a first and/or a second spring, whose function will be elaborated in the following paragraphs. In addition, the width of the backward extrusion 28 is sufficiently smaller than that of the vertical wall 20 thereby the first and second springs may positioned vertically on either sides of the backward extrusion 28. A cylindrical rod 25 is vertically coupled between a top surface plate 42 and a bottom surface plate (not shown), both fixedly coupled to the back wall 60, of the card feeder 1. The top and bottom surface plates respectively have a screw hole for mounting the cylindrical rod by a first and a second bolt (not shown). The cylindrical rod then passes through a hole of the backward extrusion 28 of the vertical element 18 to guide the card holder 10 up-and-down the chamber of the card feeder 1.

The door 12 has an L-shape handle 32 positioned on the top of the door 12 and near the back wall 60, as shown in FIG. 1. The L-shape handle 32 comprises a bottom surface coupled to a vertical surface at a distal edge and has an elongated hole in the bottom surface allowing a release plate 30 to pass through. The release plate 30 includes a bent portion, approximately at 90°, at the top and over the bottom surface of the L-shape handle 32 such that the bent portion of the release plate 30 is substantially parallel to the bottom surface of the L-shape handle 32. The bent portion of the release plate 30 thus allows a user to push of the release plate 30 downward by pressing the bent potion. A resist spring (not shown) is disposed between the bent portion of the release plate 30 and the bottom surface of the L-shape handle 32 to provide resistance against pushing down the release plate 30. Near the bottom, the release plate 30 has a slot 36 allowing a door screw (not shown) to pass through and screw into a door screw hole. The slot 36 allows vertical, but no substantial lateral, movements of the door screw within the slot 36. Also, the door screw prevents the release plate 30 from moving outward of the door 12, but it allows the release plate 30 to move vertically along the door 12. The release plate 30 further includes an L portion near the bottom right of the release plate 30 wherein the L portion has a clip notch 38 at a backward distal end. Furthermore, the door 12 is pivotally coupled to the card feeder 1 at both the front and back walls 14, 60 respectively by a first latch 26 and by a second latch 27 through a first gear 52, FIG. 2. Both the first and second latches 26, 27 are positioned respectively at the front and back side of the card feeder 1 and near the bottom of the door 12. The first and second latches 26, 27 thus allow the door 12 to be opened by pivoting at the bottom of the door 12.

Figure 2:
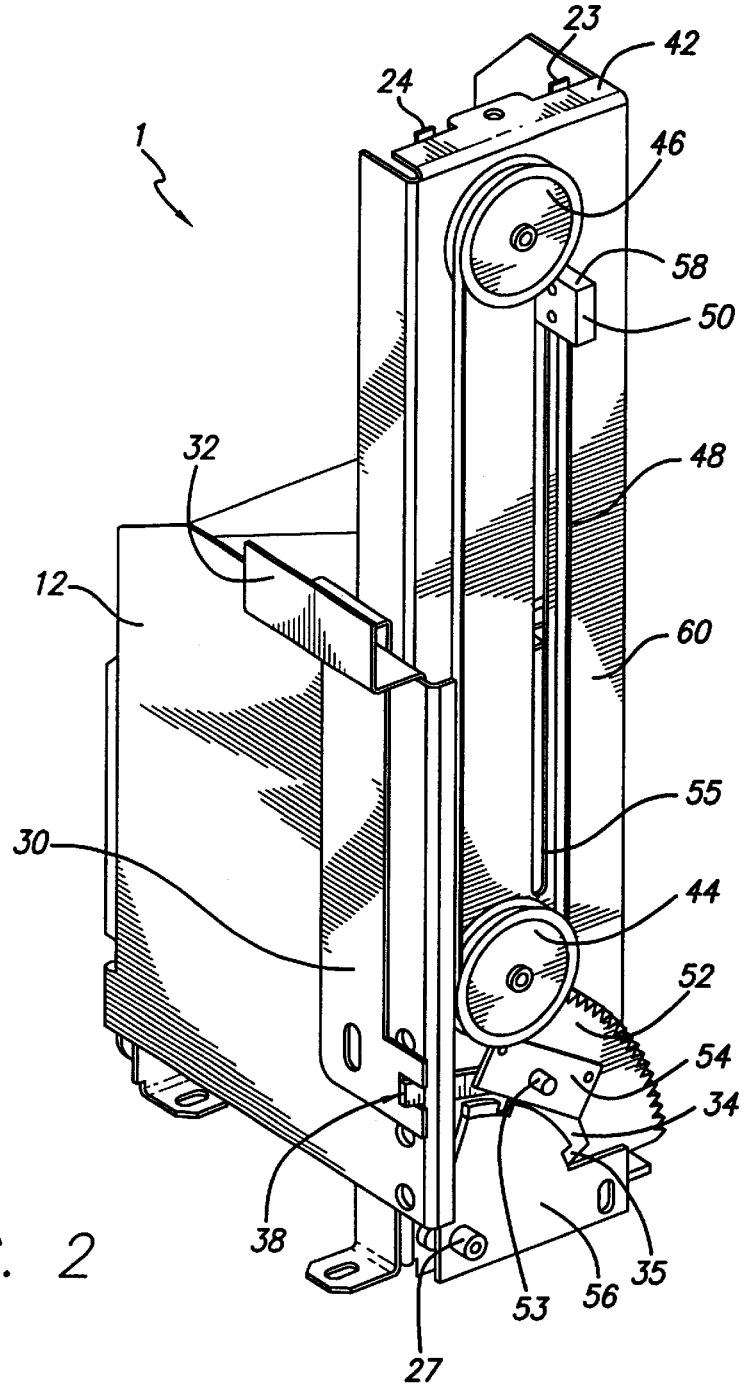
FIG. 2 shows a back isometric view of the card feeder according to the present invention.

As shown in FIGS. 1 and 2, the clip notch 38 houses a first distal end of a curved-shape lock 34. The first end of the lock 34 is slightly smaller than the clip notch 38 and it extends through a hole (not shown) of the door 12 to be engaged into the clip notch 38. The hole should be sufficiently large to allow some vertical movements of the first distal end of the lock 34. Thus, when the release plate 30 is pushed downward, the first end of the lock 34 will be moved downward accordingly.

The lock 34 is approximately centrally pivoted to the first gear 52 by a pivot 53, and it has a stop latch 35 at a second distal end, opposite to the first, as shown in FIG. 2. As a result, the lock 34 can be moved like a teeter-totter wherein each end of the lock 34 moves in an approximately opposite angular direction. The lock 34 is optionally secured by a cover plate 54 to prevent the lock 34 from falling off its position. Additionally, a position plate 56 is fixedly coupled to the back wall 60 by the second latch 27 and a fix screw (not shown). The position plate 56 is located under the lock 34 and has a first and a second notch for housing the stop latch 35 of the lock 34. When the door 12 is closed, the stop latch 35 of the lock 34 is positioned within the first notch of the position plate 56 to lock the door 12. To open the door 12, a user will need to push down the release plate 30 thereby forces the lock 34 to release the stop latch 35 from the first notch of the position plate 56.

The first gear 52 is fixedly coupled to the inside surface of the door 12 at a first distal end, and is engaged to a second gear (not shown), which is fixedly positioned between a first pulley 44 and the back wall 60 of the card feeder 1, by respective teeth of the first and the second gears. The first gear 52 is generally of shell shape and is further pivotally mounted between the position plate 56 and the back wall 60 by the second latch 27, FIG. 2. Thus, the teeth of the first gear 52 may be moved, in response to the movement of the door, in an up-side-down pendulum fashion by pivoting on the second latch 27.

When the release plate 30 is pushed downward to release the lock 34 from the first notch of the position plate 56, the door 12 then may be pivotally opened by pulling the L-shape handle 32 outward. The position plate 56 has a curved top edge allowing the stop latch 35 to slide over from the first notch toward the second notch. When the door 12 is pulled further open, the stop latch 35 eventually falls into the second notch of the position plate 56 to lock the door 12 in a loading position. As a result, by controlling the distance between the first and second notches of the position plate 56 a manufacturer of the card feeder 1 may predetermine how far the door 12 may be opened.

The card feeder 1 further comprises a second pulley 46 fixedly coupled to the back wall 60 near the top, and a Kevler belt 48 circling the first and the second pulleys 44, 46. The Kevler belt 48 has notches on its inner surface facing the first and second pulleys 44, 46, and the pulleys 44 and 46 have corresponding notches respectively on their outer circular rims to engage the notches of the Kevler belt 48. The back wall 60 has a longitudinal slot 55 substantially paralleling a right branch of the Kevler belt 48 and extending from near the second pulley 46 down to near the first pulley 44. A pull nob 50 has a plate fixedly coupled to the back side of the vertical wall 20 at a first end by passing through the slot 55. The pull nob 50 has a trench (not shown) allowing the Kevler belt 48 to pass through freely.

The location of the pull nob 50 is advantageously positioned near the second pulley 46 when the door 12 is completely close. In addition, a pull stop 58 is fixedly coupled to the Kevler belt 48 and is suitably positioned just above the pull nob 50 when the door 12 is completely closed. In the preferred embodiment, the pull stop 58 is made of metal material which fixedly grip the Kevler belt 48. The pull stop 58, however, may have any suitable shapes or forms and/or may be made by any suitable materials other than metal.

Figure 3:
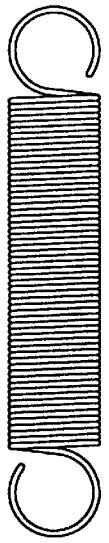
FIG. 3 shows a spring of the card feeder according to the present invention.

FIG. 3 shows a preferred embodiment of the first and second springs according to the present invention. As shown in FIGS. 1 and 2, the top surface plate 42 has a first and a second small extrusion 23, 24 facing toward the card holder 10. Correspondingly, the vertical element 20 has a third and a fourth small extrusion (not shown) respectively positioned in substantially same vertical planes of the first and second small extrusions 23, 24. A respective first distal ends of the first and second springs respectively hang on the first and second small extrusions 23, 24, and a respective second distal ends, opposite to the first, of the first and second springs respectively hang on the third and fourth small extrusions of the vertical element 20 to provide upward pulling forces to the card holder 10. As a result, the first and second springs, when mounted, are substantially parallel to each other.

The first and second springs act coordinately as a counter weight to the card stack upheld by the card holder 10. Thus, they pull the card holder 10 upward so that the uppermost card of the card stack will be in place ready to be fed into the receiving device. Preferably, the first and second springs should be close to their natural rest state without extension when the card holder 10 is in its uppermost position. Furthermore, the first and second springs should be suitably long enough to provide a more linear stretch resistance force during the course of extension when the card holder 10 is at its bottommost position, i.e., when the door 12 is fully opened for loading cards. As a result, every card of the stack, from the bottommost to the uppermost card, will experience a substantially constant upward pulling force, and thus the frictions to be overcome by the feeding mechanism will be accordingly approximately the same.

As mentioned, the first gear 52 is fixedly coupled to the door 12 at one end. Thus, when the door 12 is pulled opened, the first gear 52 pivotally moves with the door 12 and rotates the second gear, which, in turn, rotates the first pulley 44. The first pulley 44 then pulls the Kevler belt 48 clockwise causing the pull stop 58 to push the pull nob 50 downward. As the pull nob 50 is pushed downward by the pull stop 58, the card holder 10 is accordingly moved downward. Conversely, when the door is moving toward close, the first gear 52 will rotate the second gear causing the second gear to rotate the first pulley 44 counterclockwise. The first and second springs then are free to pull the card holder 10 upward until the pull nob 50 reaches the pull stop 58.

There will be frictions among the first and second gears, the first and second pulleys, and the Kevler belt, etc., against moving the door 12 in either directions once it has been opened. The first and second springs are chosen sufficiently long so that they provide adequate pulling force for the card holder 10, but not so strong a pulling force as to overcome the above-mention frictions and push up the pull stop 58 when the door 12 is open. Therefore, the door 12 may stay at any open angle for loading cards without worrying being shut up by the first and second springs. The preferred embodiment of the present invention thus allows a one-hand loading operation by the user. In an alternative embodiment, the pulling force of the first and second springs, however, may be chosen to be stronger than the above-mentioned frictions. In addition, the door 12 may be pulled further open until the stop latch 35 of the lock 34 is locked into the second notch of the position plate 56. Once the stop latch 35 is locked into the second notch of the position plate 56, the door 12 is locked in its loading position and cannot be moved until the user pushes the release plate 30 to release the stop latch 35 from the second notch. This also allows a one-handed operation of the card feeder 1.

From the foregoing, it will be appreciated that, although specific embodiments of the invention have been described herein for purposes of illustration, various modifications may be made by persons skilled in the art without deviating from the spirit and/or scope of the invention. For example, the dimensions of the card feeder 1 may vary to adapt to different size of the receiving device and/or feeding mechanism. The position plate 56 may also have more than two notches for different open loading positions. Furthermore, the first and/or second springs may also be positioned under the card holder 10 for providing upward pushing forces. The release plate 30 and/or the door handle 32 may also be positioned differently.

What is claimed is:

1. A medium holding device for holding a stack of media to be fed into a receiving device, comprising:

a door;

a back wall, said back wall having an elongated vertical slot;

a medium holder for holding the stack of media;

a door locking mechanism adapted to lock said door in a closed operational position and in an open loading position, said door locking mechanism being coupled to said door and to said back wall;

a door opening mechanism coupled to said door locking mechanism and adapted to release said door locking mechanism for unlocking said door;

a pulley assembly coupled to said door locking mechanism for moving said medium holder vertically, said pulley assembly being further coupled to said back wall; and an elastic means coupled to said medium holder for providing upward pulling forces to said medium holder.

2. The medium holding device of claim 1 wherein the medium holder comprises a platform and a vertical element.

3. The medium holding device of claim 2 wherein a top surface of said platform is angled from a horizontal position.

4. The medium holding device of claim 2 wherein said vertical element comprises a guiding means to guide said vertical movement of the medium holder.

5. The medium holding device of claim 1 wherein the door locking mechanism comprises:

a lock gear coupled to the door;

a lock pivotally coupled to said lock gear, said lock having a stop latch at a first distal end; and a lock plate coupled to said back wall, said lock plate having a plurality of notches for housing the stop latch of the lock.

6. The medium holding device of claim 5 wherein said door opening mechanism comprises:

a release plate coupled to a second distal end of said lock for releasing the stop latch from the notches and unlocking the door; and a resistance element for resisting pushing down the release plate to unlock said door.

7. The medium holding device of claim 6 wherein said door has a door handle and said release plate is bent approximately 90° at the top and is parallel to a bottom portion of the door handle for pressing said resistance element between the bent portion of said release plate and the bottom portion of the door handle.

8. The medium holding device of claim 7 wherein said resistance element comprises a resisting spring.

9. The medium holding device of claim 1 wherein said pulley assembly comprises:

a first pulley coupled to said door locking mechanism;

a second pulley coupled to said back wall;

a belt coupled to said first and second pulley, said belt having notches engaged to respectively notches of said first and second pulley; and a pull hold adapted to pull said medium holder vertically, said pull hold fixedly coupled to said medium holder and to said belt.

10. The medium holding device of claim 9 wherein said pull hold comprises:

a pull nob fixed coupled to said medium holder through the vertical slot, said pull nob having a trench for said belt to pass through freely; and a pull stop fixedly coupled to said belt above the pull nob such that said belt being adapted to move said medium holder vertically by rotating said first pulley.

11. The medium holding device of claim 9 wherein said pulley assembly further comprises a pulley gear fixedly coupled between said first pulley and said back wall, said pulley gear being engaged to the door locking system for rotating said first pulley in response to a movement of said door.

12. The medium holding device of claim 9, further comprising:

first and second gears, said first gear coupled to said door at a first end, said first gear being adapted to pivotally move with said door when opening and rotate said second gear, said second gear being adapted to rotate said first pulley, said first pulley being adapted to pull said belt clockwise thereby moving said medium holder towards said bottom elevation.

13. The medium holding device of claim 12, further comprising at least one spring coupled to said back wall at a first end and to said medium holder at a second end, opposite to said first end, for providing upward pulling forces to said medium holder.

14. The medium holding device of claim 13, further comprising first and second springs, said first spring being parallel to said second spring.

15. The medium holding device of claim 9, further comprising first and second gears, said first gear coupled to said door at a first end, said first gear being adapted to pivotally move with said door when closing and rotate said second gear, said second gear being adapted to rotate said first pulley, said first pulley being adapted to pull said belt counterclockwise, thereby moving said medium holder towards said top elevation.

16. The medium holding device of claim 1 wherein said elastic means comprises a first spring, said first spring being coupled to said back wall at a first end and to said medium holder at a second end, opposite to the first, for providing upward pulling forces to said medium holder.

17. The medium holding device of claim 16 wherein said elastic means further comprises a second spring positioned parallel to the first spring, said second spring being coupled to said back wall at a first end and to said medium holder at a second end, opposite to the first, for providing upward pulling forces to said medium holder.

18. The medium holding device of claim 1, further comprising at least one spring coupled to said back wall at a first end and to said medium holder at a second end, opposite to said first end, for providing upward pulling forces to said medium holder.

19. The medium holding device of claim 1, further comprising means for temporarily maintaining said door in an open position at at least one angle for loading media.

20. The medium holding device of claim 19, said means for maintaining said door in an open position at at least one angle comprising:

said pulley assembly comprising:

a first pulley coupled to said door locking mechanism;

a second pulley coupled to said back wall;

a belt coupled to said first and second pulley, said belt having notches engaged to notches of said first and second pulley respectively;

at least one spring coupled to said back wall at a first end and to said medium holder at a second end, opposite to said first end, for providing upward pulling forces to said medium holder; and first and second gears, said first gear fixedly coupled to said door at a first end, said first gear being adapted to pivotally move with said door and rotate said second gear, said second gear being adapted to rotate said first pulley, said first pulley being adapted to pull said belt.

21. The medium holding device of claim 20, said means for temporarily maintaining said door in an open position at at least one angle further comprising first and second springs, said first spring being parallel to said second spring.

22. The medium holding device of claim 20, said means for temporarily maintaining said door in an open position at at least one angle further comprising a pull hold adapted to pull said medium holder, said pull hold fixedly coupled to said medium holder and to said belt.

23. The medium holding device of claim 20, wherein said first pulley is adapted to pull said belt clockwise when opening said door.

24. The medium holding device of claim 20, said first pulley being adapted to pull said belt counterclockwise when closing said door.

25. A medium holding device for holding a stack of media to be fed into a receiving device, comprising:

a medium holder for holding the stack of media;

a door pivotally coupled to the medium holding device, said door having a door handle;

a first gear coupled to said door;

a lock pivotally coupled said first gear, said lock having a stop latch;

a locking element having at least two notches for housing the stop latch;

a release plate coupled to said lock for pressing said lock to release the stop latch from the notches;

a first pulley;

a second gear fixedly coupled to said first pulley for rotating said first pulley, said second gear being engaged to said first gear for rotation in response to a movement of said door;

a second pulley;

a belt coupled to said first and second pulleys for rotating said first and second pulleys;

a pulling nob fixedly coupled to said medium holder and to said belt for vertically moving said medium holder when the first pulley rotates; and an elastic means coupled to said medium holder for providing upward pulling forces to said medium holder.

26. A medium holding device for holding a stack of media to be fed into a receiving device, said medium holding device comprising:

a medium holder adapted for movement between a bottom elevation and a top elevation, said medium holder being adapted to feed media into a receiving device;

a door adapted to move between an open position and a closed position, said door being coupled to said medium holder;

elastic means adapted to pull said medium holder in a first direction; and a counteracting mechanism coupled to said medium holder, the counteracting mechanism being adapted to interrupt the travel of said medium holder as said medium holder moves between said bottom elevation and said top elevation, said counteracting mechanism comprising a pulley assembly and a locking mechanism coupled to said pulley assembly and to said door for locking said door closed and for pulling said medium holder according to said opening or closing movements of said door.

27. The medium holding device of claim 26, wherein said door is pivotally coupled near said bottom of said medium holder, said medium holder further comprising a release mechanism coupled to said locking mechanism for locking or unlocking said door.

28. The medium holding device of claim 27, wherein said locking mechanism comprises a first gear and said pulley assembly comprises a second gear engaged to said first gear, said first gear being coupled to said door such that said first gear rotates said second gear when said door moves between said open position and said closed position.

29. The medium holding device of claim 28, wherein said pulley assembly further comprising:

a first pulley coupled to said second gear, said second gear being adapted to rotate said first pulley in responses to said door moving between said open position and said closed position;

a second pulley;

a belt coupled to said first and second pulley, said belt having notches engaged to respective notches of said first and second pulleys for rotating said first and second pulleys; and a pull nob coupled to said belt and to said medium holder, said pull nob being adapted to move said medium holder between said bottom elevation and said top elevation when said belt rotates.

30. The medium holding device of claim 28, said locking mechanism further comprising:

a lock plate, said lock plate having at least two notches; and a lock pivotally coupled to said first gear and engaged to said release mechanism at a distal end, said lock having a stop latch adapted to be released from said notches of said lock plate by said release mechanism.

31. The medium holding device of claim 26, wherein said elastic means comprise at least one spring coupled to said medium holder for pulling said medium holder against gravity between said bottom elevation and said top elevation, said at least one spring being substantially in a rest state when said medium holder is at said top elevation.

32. The medium holding device of claim 31, further comprising means for guiding the movement of said medium holder.

33. The medium holding device of claim 32, wherein said guiding means comprise a rod operatively coupled to said medium holder, said medium holder sliding along said rod in a plane between said top elevation and said bottom elevation, said rod mounted substantially parallel to said at least one spring within said medium holder.

34. The medium holding device of claim 33, wherein said counteracting mechanism comprises a pulley assembly operatively coupled to said medium holder for pulling said medium holder against an elastic force of said at least one spring along said rod, a first gear operatively coupled to said pulley assembly for actuating said pulley assembly and a second gear operatively coupled to said first gear for actuating a spring counteracting force of said pulley assembly to load said medium holder with media at any elevation and for releasing said spring counteracting force of said pulley assembly at any elevation.

35. The medium holding device of claim 26, said door being adapted to move between an open position and a closed position, said counteracting mechanism being further adapted to temporarily maintain said door in an open position at at least one angle as said door moves between said open position and said closed position.

36. The medium holding device of claim 26, said counteracting mechanism being adapted to stop said medium holder at at least one point between said bottom elevation and said top elevation.

37. The medium holding device of claim 26, said door being adapted to move between an open position and a closed position, said counteracting mechanism being further adapted to stop the movement of said door as said door moves between said open position and said closed position.

38. The medium holding device of claim 26, said counteracting mechanism being adapted to slow said medium holder as said medium holder travels between said top elevation and said bottom elevation.

* * * * *